United States Patent [19]

Emich

[11] 4,391,382

[45] Jul. 5, 1983

[54] CONTAINER HAVING A SAFETY CLOSURE

[75] Inventor: Werner Emich, Bensheim-Langwaden, Fed. Rep. of Germany

[73] Assignee: Friedrich Sanner GmbH & Co. KG, Bensheim, Fed. Rep. of Germany

[21] Appl. No.: 359,072

[22] Filed: Mar. 17, 1982

[30] Foreign Application Priority Data

Mar. 18, 1981 [DE] Fed. Rep. of Germany ..... 3110514

[51] Int. Cl.[3] ..... B65D 55/02

[52] U.S. Cl. ..... 215/213; 215/296

[58] Field of Search ..... 215/211, 213, 218, 221, 215/296

[56] References Cited

U.S. PATENT DOCUMENTS 3,130,848 4/1964 Chancellor ..... 215/213

3,528,581 9/1970 Lange, Jr. ..... 215/213

*Primary Examiner*—George T. Hall

[57] ABSTRACT

Container with safety closure, for pharmaceutical preparations or chemicals, having a cylindrical safety sleeve (24; 124) projecting above the end surface of the container neck and disposed externally on the container neck and its projecting portion conformingly receives the circumferential surface of a grip plate (16; 116) of a stopper (14; 114) in the container-closed position. The bottom of the grip plate (16; 116) facing the container mouth rests upon an annularly circumferential radial surface (30; 130) of the safety sleeve (24; 124). The safety sleeve (24; 124) and the container neck (22; 122) are in complementary screw threaded engagement with one another over a limited distance in the opening direction of the stopper (14; 114) and are secured against axial separation from one another. The safety sleeve (24; 124) has at least one projection (36; 136) directed radially inwardly from its inside surface, which is snapped over a first annular bead (32; 132) on the outside surface of the container neck (22; 122), the first annular bead being directed radially outwardly and situated ahead of the projection in the opening direction.

20 Claims, 7 Drawing Figures

Figure 4:
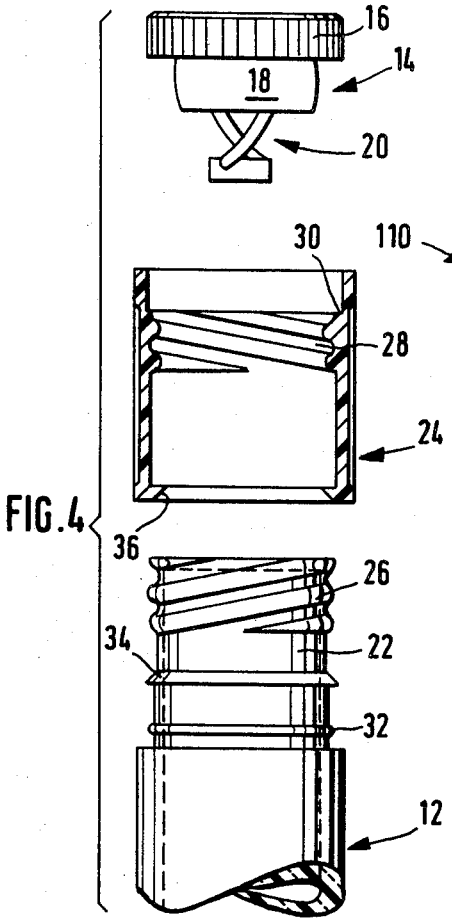

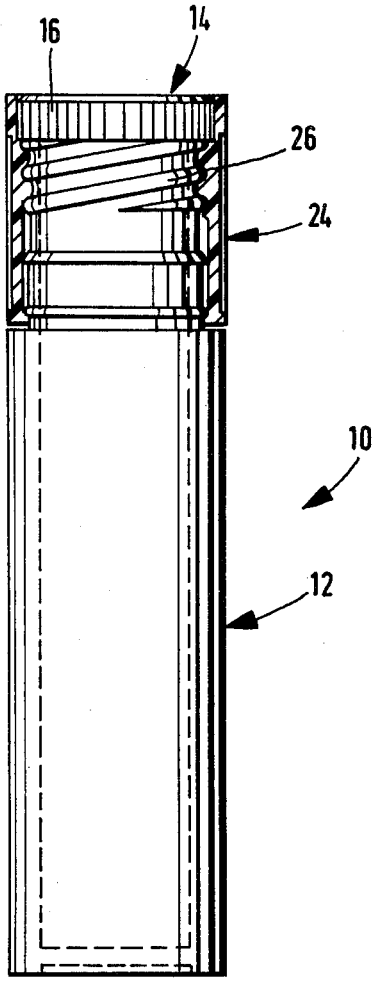
FIG. 1
FIG. 2
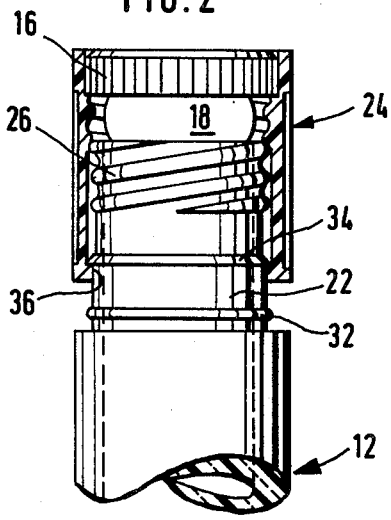
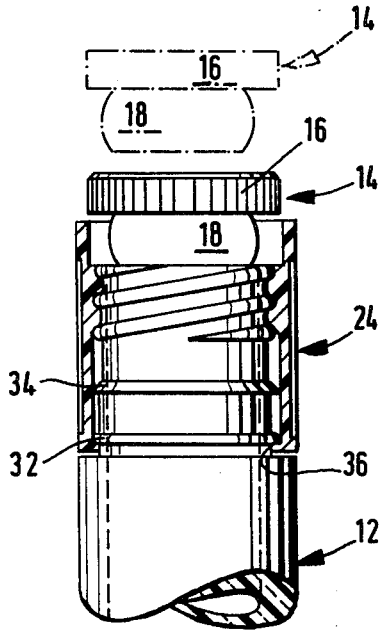
FIG. 3

CONTAINER HAVING A SAFETY CLOSURE

BACKGROUND

The invention relates to a container having a safety closure, especially a container of glass, metal or plastic for pharmaceutical preparations or chemicals, which can be opened for removal of the contents or closed by pressing into the tubular neck of the container a stopper which has a disk limiting the depth to which the stopper can be inserted and serving for grasping with the fingers.

Containers with safety closures serve especially for containing potentially harmful or toxic substances, i.e., chemicals, cleaning agents, cosmetics, drugs and the like, which must be made inaccessible to children. These containers, therefore, must serve not only for proper storage of their contents, but must also prevent small children from opening the container and being harmed by eating or touching the contents thereof. On the other hand, the removal of the contents must be able to be accomplished quickly and easily by an authorized person instructed in the use of the safety closure, so that the closure will actually be used and not laid aside after the container is first opened or replaced with a common stopper that is easier to use. Since safety closures serve essentially for the protection of children, they are also referred to as "child-proof" closures.

A wide variety of closures has been proposed for the purpose set forth above. In the case of screw caps for drug vials, for example, one type is commonly used in which the closure consists of the screw cap proper and a turning cap surmounting the screw cap which is urged by resilient elements to a position in which it will not engage the screw cap when rotated in the opening direction, i.e., it slips, so that the vial remains closed by the screw cap. However, the turning cap can be forced against the action of the resilient elements into a position in which it engages the screw cap, thus making it possible to unscrew the latter. On the other hand, closures using stoppers retained by friction have been rendered child-safe by constructing the stopper such that it cannot be grasped directly by the hand, and a tool for the extraction of the stopper is provided in a recess in a button surmounting the stopper. This tool is formed on a ring which is injection molded integrally with the stopper and attached to it by easily broken connectors, the ring serving simultaneously in this case as a so-called originality seal (DE-PS No. 20 35 747). This closure has proven effective in its safety function. It has been found disadvantageous, however, that, once the container has been opened, the ring with the integral tool is no longer attached to the closure and therefore it can be lost.

THE INVENTION

It is therefore the object of the invention to create a container having a safety closure in the form of a stopper which can be opened and closed easily by a person instructed in its operation without a separate and easily lost tool, while the stoppers commonly used heretofore for the unsecured closing of pill bottles, for example, are to be nevertheless usable.

Setting out from a container of the kind mentioned above, this object is achieved by the invention by the fact that a cylindrical safety sleeve projecting above the mouth of the container is disposed externally on the container neck and its projecting portion encases the circumferential surface of the finger-grip disk surmounting the stopper when the container is in the closed state, while the bottom of the finger-grip disk facing the container mouth rests upon an annular abutment provided within the safety sleeve, by the fact that the safety sleeve and the top of the container are in complementary threaded engagement with one another over a limited distance in the direction of the opening of the stopper, and by the fact that the safety sleeve has at least one projection extending inwardly from its inner surface and snapping over a first annular bead on the exterior of the container neck. The projecting portion of the safety sleeve therefore prevents the disk of the stopper from being grasped with the fingers, so that it is secured against extraction from the neck of the container. When the safety sleeve is rotated in the unscrewing direction, it is first displaced in the direction of the opening of the stopper by the screw thread engagement, pushing the stopper along with it. The disk of the stopper is still retracted within the safety sleeve and therefore is inaccessible, so that it is still impossible to grasp the stopper. Not until the safety sleeve is again intentionally turned back in the screw tightening direction does the knob of the stopper emerge from the safety sleeve and the stopper can then be grasped with the fingers and extracted.

To enable the safety sleeve to be installed on the container neck so as to resist removal therefrom in the axial direction, a second annular bead is provided on the container neck at a distance above the first annular bead corresponding at least to the thickness of the disk, and this second bead abuts against the internal projection of the safety sleeve after the latter has snapped over and passed beyond the first annular bead as the safety sleeve is rotated in the unscrewing direction.

The internal projection of the safety sleeve is best also made in the form of a continuous circumferential internal bead.

It is desirable to design the closure such that the projection extending radially inwardly from the safety sleeve will be provided in the end portion of the sleeve confronting the body of the container, and such that the complementary threaded sections of the safety sleeve and container neck are offset axially towards the mouth of the container.

In an advantageous further development of the invention, the upper surface of the second bead on the container neck is a ramp surface sloping downwardly and outwardly, while the lower surface thereof is substantially radial. Now, if the projection extending radially inwardly from the safety sleeve is in the form of an internal bead and has a cross section of a shape that is complementary to the cross section of the second annular bead of the bottle neck, the ramp surfaces of the beads can slide one on the other with resilient deformation when the sleeve and container are assembled, but the radial surfaces of the beads will engage one another if axial disassembly is attempted and make such disassembly impossible.

The safety sleeve is therefore best made of an elastically expansible material, preferably of plastic, and the sleeve as well as the stopper are preferably made from plastic by injection molding.

The threaded portions of the safety sleeve and of the container neck are preferably provided with multiple complementary threads, which then can have a relatively steep thread pitch. The amount of rotation necessary to produce the necessary opening movement of the safety sleeve can thus be limited to about one half turn of the safety sleeve.

In an advantageous further development of the invention, the axial length of the threaded sections of the safety sleeve and container neck as well as the distance between the second and first annular bead on the container neck can be such that the threaded section of the safety sleeve, when the latter is turned in the opening direction, will engage the threaded section of the neck of the container to a point at which it will come free of the latter and then rotate freely on the container neck. In other words, the safety sleeve, when in the fully unscrewed position, is able to rotate freely in both directions, while at the same time the finger-grip disk of the stopper will remain encased within the safety sleeve, i.e., it cannot be grasped. Not until the safety sleeve is turned in the screw tightening direction while simultaneously applying axial pressure towards the container, thus enabling the complementary threaded sections to engage again and thus bring the safety sleeve back to the closed position, does the finger-grip disk become accessible, since the stopper, due to its tight fit in the neck of the container, will be held in a position in which it is partially withdrawn from the container neck, i.e., it is not driven back in with the safety sleeve. The fact that screwing the safety sleeve back onto the neck requires the application of an additional axial pressure constitutes an additional security against unauthorized opening, because only users who are informed of this requirement will apply this axial pressure.

The portion of the stopper that enters into the mouth of the container can either be in the form of a plug that is oversize in relation to the inside diameter of the container mouth or in the form of an undersized cylindrical plug that is sealed in the mouth of the container by means of radially projecting integral fins.

The stopper can furthermore be provided in a known manner with a hold-down that is compressible axially, or it can also be provided with a silica gel insert.

The circumferential surface of the finger-grip disk and/or of the safety sleeve is best provided with knurling or the like, which can be created by the injection molding process if the disk is made of plastic.

To facilitate the operation of the safety sleeve even by persons whose hands are weakened, for example by arthritis or gout, it is recommendable to provide the safety sleeve with an other than cylindrical configuration, i.e., a polygonal or polyhedral circumferential shape. This will make the safety sleeve easy to grip, and the lever arm at which the turning force is applied will be increased at the corners of the polygon in comparison to a cylindrical safety sleeve, i.e., the same turning effort will apply a greater torque. In addition, the polygonal safety sleeve can also be held, for example by pinching it in a drawer gap and applying the opening force to the container which, if made of appropriate shape and size, will be easier to grip and turn with less effort relative to the safety sleeve.

If the plug part of the stopper has a cylindrical or barrel-shaped circumferential surface it may be desirable to provide on the outer surface of the plug part that enters the container neck a circumferential annular bead, with which there is associated another annular bead on the inside surface of the container neck, these beads being arrayed axially such that, when the stopper is pressed into the container neck, the bead provided on the plug part will, just before reaching the intended final position, snap over the annular bead in the container neck. When the previously opened closure is reclosed, and the stopper is pressed into the container neck, therefore, a snapping noise will be produced, to indicate acoustically that the container has been reclosed correctly, i.e., that it is child-safe. If the snapping noise is not heard, the user will know that he has not yet turned the safety sleeve all the way back to the closed position in the required manner, and that therefore the stopper cannot yet be pressed all the way to the proper closed position.

At the same time, the annular bead on the plug part has the purpose of sealing the interior of the container against the penetration of ambient air. This seal is further improved if the inside diameter of the container neck is made slightly smaller in its portion immediately below the annular bead than the inside diameter of the portion above the annular bead.

Figure 5:
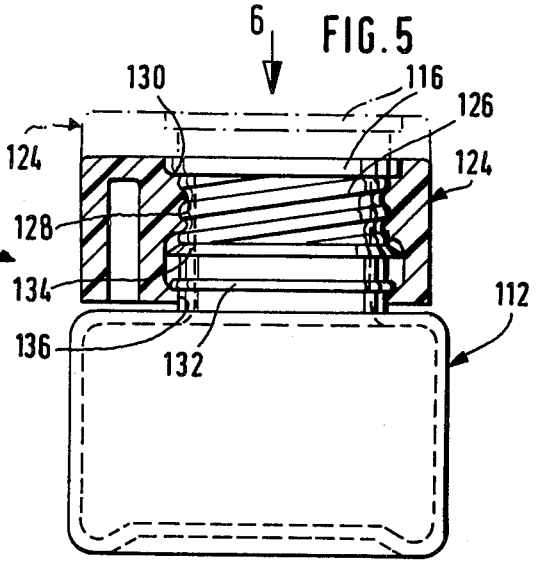
Figure 6:
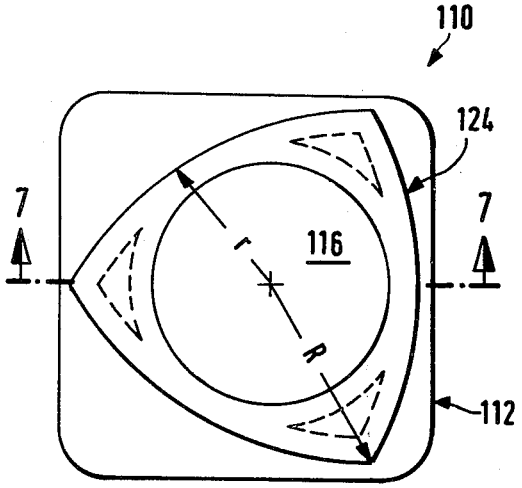
Figure 7:
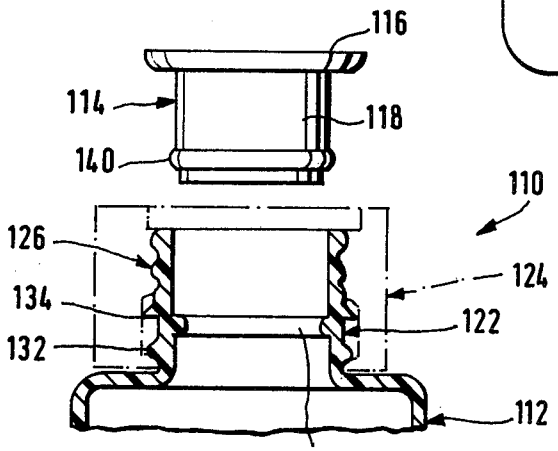

The invention will be further explained in the following description of a number of its embodiments in conjunction with the drawing, wherein:

FIG. 1 is a partially cross-sectional elevational view of a container provided in the manner of the invention with a safety seal, the container being in the closed state, FIG. 2 is a fragmentary elevational view corresponding to FIG. 1 of the upper part of the container, after a first step in the action of opening the container, FIG. 3 is a view corresponding to FIG. 2 after a second step in the action, FIG. 4 is an exploded view of the upper part of the container and of parts of the safety seal, in a view corresponding to FIGS. 1 to 3, FIG. 5 is a fragmentary elevational view of a second embodiment of a container provided with a safety closure in the manner of the invention, the container being in the closed state, FIG. 6 is a top view of the container, seen in the direction of the arrow 6 in FIG. 5, and FIG. 7 is a fragmentary elevational view of a cross-section made through the neck portion of the container shown in FIGS. 5 and 6, as seen in the direction of the arrows 7—7 of FIG. 6, and of the stopper withdrawn from the container neck, the safety sleeve being represented in broken lines for the sake of clarity.

The embodiment represented in the drawings of a container and safety stopper of the invention, designated as a whole by the number 10, is a cylindrical pill bottle 12, which is closed by a stopper 14 pressed into the open mouth of the pill bottle. In the illustrated example, the stopper 14 (FIG. 4) is in the form of a barrel-shaped plug part 18 provided with a knurled or ribbed finger-grip disk 16, and from its hollow interior there projects a presser 20 which can be forced resiliently upward in the axial direction.

The pill bottle 12 is provided at its stoppered end with a neck portion 22 that is slightly constricted with respect to the rest of the outside diameter of the bottle, and on it there is placed a safety sleeve 24 injection molded of plastic and having longitudinal ribs on its cylindrical outside surface, its outside diameter corresponding approximately to the outside diameter of the pill bottle 12.

The neck portion 22 of the pill bottle 12 has in its portion immediately adjacent the mouth a threaded section 26 provided with a multiple thread, which corresponds to a complementary threaded section 28 in the interior of the safety sleeve 24. The safety sleeve 24 projects above the mouth of the neck section 22 by an amount corresponding to the thickness of the finger grip disk 16 of the stopper 14, such as to enclose the circumferential surface of the finger grip disk 16, so that the circumference of the grip disk cannot be grasped by the hand. The outer margin of the bottom surface of the finger grip disk rests on a circumferential radial ledge 30 in the safety sleeve, so that the grip disk 16 and hence the stopper 14 will be shifted axially by an axial movement of the safety sleeve away from the mouth of the pill bottle, but will not be carried back again by the sleeve when the latter is returned to its original position.

In the area below the threaded section 26, the neck 22 is provided with two circumferential beads 32 and 34, which are spaced apart from one another, the first bead 32 being just above the ledge formed on the neck at the transition from the neck to the full diameter of the pill bottle, while the second annular bead 34 is disposed at a distance above the first bead corresponding at least to the thickness of the finger grip disk 16. An annular bead 36 projecting radially inwardly from the bottom end of the safety sleeve 24 abuts against the bottom of the first annular bead 32 of the neck 22 when the pill bottle is closed. The safety sleeve 24 can be unscrewed axially upwardly as a result of the engaged threaded sections 26 and 28, but at the beginning of the screwing movement some effort is necessary in order to force the annular bead 36 to unsnap from the first annular bead 32 on the neck 22 with a resilient expansion of the bottom end of the safety sleeve. The unscrewing movement can then continue until the annular bead 36 abuts against the second annular bead 34 on the neck 22, and then only the force retaining the plug 18 in the mouth of the pill bottle, which is considerably less than the unsnapping force mentioned above, means to be overcome in order to open the pill bottle.

When the safety sleeve is unscrewed, the stopper 14 is lifted by its finger grip disk 16, and the plug part 18 is at least partially withdrawn from the mouth of the bottle. If the safety sleeve is then screwed back in the opposite direction until its annular bead 36 snaps down over the annular bead 32, the plug remains in the withdrawn position and the then exposed finger grip disk can be grasped and the stopper completely removed. For closing the pill bottle, no unusual manipulations need to be performed; instead, the stopper is simply pressed as usual into the open end of the safety sleeve and thus into the mouth of the pill bottle.

The safety function of the closure constructed in the manner of the invention is therefore based on the fact that the stopper, which cannot normally be grasped because it is concealed in the safety sleeve, has to be brought, by two screw turning operations in opposite directions, to a position in which its finger grip disk is accessible, while at the beginning of the first screw turning operation a break-loose effort must be applied to the safety sleeve which is not commonly required in screw closures, and which is not made by small children, at least when they do not understand how the closure works.

The second annular bead 34 provided on the neck 22 of the pill bottle 12 and the annular bead 36 of the safety sleeve 24 are best made with complementary wedge-shaped cross sections such that the ramp surfaces will slide one over the other during the downward screwing movement, with an expansion of the safety sleeve, while in the unscrewing movement, radially disposed surfaces on the beads will abut against one another and prevent the safety sleeve from being completely unscrewed past the second annular bead 34. It is desirable, on the other hand, to make the cross section of the first annular bead 32 such that it will be possible to unscrew the safety ring, even if only by the application of an appropriately elevated releasing effort. Therefore, the bottom surface of the first annular bead 32, which seeks to prevent the release of the annular bead 36 when the safety sleeve is unscrewed, ought not to be radial but rounded over or slightly beveled.

The safety effect can be further improved if the axial length of the threaded sections 28 and 26 on the safety sleeve 24 and on the container neck 22, respectively, is relatively short and the distance between the first bead 32 and the second, radial bead 34 provided on the neck of the container is sightly longer than that, because the threaded section 28 of the safety sleeve 24 can then, when turned in the unscrewing direction, reach a position in which it is disengaged from the threaded section 26 on the container neck, and then be freely rotatable on the neck without imparting an axial component of movement to the sleeve. The finger grip disk 16 in that case will still be withdrawn within the safety sleeve 24, i.e., the stopper still cannot be grasped. Not until the safety sleeve is turned in the opposite direction with the simultaneous applications of pressure toward the interior of the pill bottle will the threaded sections 28 and 26 engage one another and draw the safety sleeve back into place, thereby uncovering the stopper 14 and enabling it to be grasped.

The modified container 110 illustrated in FIGS. 5 to 7 is largely the same as the container 10 previously described with regard to the operation of the safety closure, and equal parts are provided with the same reference numbers prefixed with "1". To avoid unnecessary repetition, therefore, it will suffice here to describe only the differences, while for the features that are the same, the preceding description can be consulted. The container 110 is in this case in the form of a bottle of rectangular cross section in plan, made for example of plastic by the blowing method, and intended to contain medicaments. The safety sleeve 124 has, as best seen in FIG. 6, not a cylindrical circumferential surface, but one of a triangular cross-sectional shape in plan, with outwardly arched sides of equal length. It is apparent that the distance R from the longitudinal central axis of the safety sleeve to the corners of the triangle is greater than the distance r from the longitudinal central axis to the center of each of the triangular sides, i.e., the torque exercised by a user on a corner of the safety sleeve when unscrewing the latter is applied to the comparatively longer lever arm R, i.e., a greater unscrewing torque is achieved by the same effort.

The plug part 118 of the stopper 114, unlike the barrel-shaped plug part 18 in the case of container 10, is cylindrical, and has an annular bead 140 as its sealing element. With the annular bead 140 there is associated in the interior of the container neck 122 an annular bead 142 over which the annular bead 140 snaps when the stopper 114 is pressed all the way into the container neck 122 in the manner described above. The snapping noise thus produced indicates acoustically that the proper closed position has been reached. The portion of the neck below the annular bead 142 is made with a slightly smaller diameter than the portion above the bead, so that the annular bead 140 of the stopper will press and seal more tightly against the inner wall of the container neck when it is properly seated than when it is inserted in the neck to such an extent that it is still above the annular bead 142, in a position where the tension is only great enough for the plug part 114 to be held with light friction in the container neck 122 and therefore cannot accidentally drop out if the container 110 is turned upside down.

Modifications and further developments of the above-described embodiments of the invention are possible within its scope. For example, the relative arrangement of the threaded sections 26, 28 or 126, 128, and of the annular beads 32, 34 and 36, and 132, 134 and 136 on the neck section 22, 122, and in the safety sleeve 24, 124, can also be reversed such that the threaded sections are located at the bottom end and the annular beads on the mouth end of the neck 22, 122, and of the safety sleeve 24, 124, as the case may be. Additional possible modifications relate to further improvements of the stopper, which, for example, can be provided with a silica gel cartridge instead of the hold-down 20. It is to be considered an important advantage of the containers constructed in the manner of the invention that not only the stoppers now in use in non-child-proof containers, but also the filling and stoppering machines used for the filling and automatic insertion of stoppers and the closing of the containers can continue to be used, i.e., no investments are necessary for stopper inserting and pressing machines especially adapted to the new safety container closure, if the container is supplied with the safety sleeve pre-installed.

I claim:

1. In combination: a container, especially a container of glass, metal or plastic material for pharmaceutical preparations or chemicals, said container having a tubular neck and an open mouth surrounded by an end face, a stopper adapted to be pushed into the mouth of the container neck and having a grip plate with a bottom surface limiting the extent to which the stopper can be inserted into the neck and also having a circumferential surface permitting grasping of the stopper by a person, and a safety sleeve projecting above the end face of the container neck, being disposed externally on the container neck and having a projecting portion conformingly receiving the circumferential surface of the grip plate of the stopper in the closed position of the container, the bottom surface of the grip plate resting upon an annular circumferential radial surface of the safety sleeve, screw-threaded sections on said sleeve and said container neck in the complementary engagement with one another over a limited distance when looking in the opening direction of the stopper and being secured against axial separation from one another, the safety sleeve having at least one projection directed radially inwardly from an inside surface thereof, said projection being snapped over a first annular bead on the outside surface of the container neck, said first annular bead being directed radially outwardly and situated ahead of the projection when looking in the opening direction of the stopper.

2. The combination of claim 1, wherein a second radially outwardly directed annular bead is provided at a distance from said first annular bead to the mouth of the container neck corresponding at least to the thickness of the grip plate, said radially inwardly directed projection of the safety sleeve abutting against said second bead after snapping over and past said first annular bead when the safety sleeve is turned in the unscrewing direction.

3. The combination of claim 1, wherein said radially inwardly directed projection of the safety sleeve is a circumferentially closed annular bead.

4. The combination of claim 3, wherein said radially inwardly directed projection is adjacent the end of the safety sleeve remote from the stopper, and the screw-threaded sections are offset in axial direction from said end towards the container mouth on the outside of the container neck and on the inside of the safety sleeve respectively.

5. The combination of any one of claims 2 to 4, wherein said second annular bead has an increasingly wedge-shaped cross section in a direction away from the container mouth, said cross section being defined at its end facing away from the container mouth by an edge running substantially radially.

6. The combination of claim 5, wherein the radially inwardly directed projection of the safety sleeve has a wedge-shaped cross section complementary to the second annular bead of the container neck.

7. The combination of claim 1, wherein said safety sleeve is made from a resiliently expansible material.

8. The combination of claim 1, wherein at least one of said stopper and safety sleeve are injection molded of plastic.

9. The combination of claim 1, wherein said screw-threaded sections of the safety sleeve and of the container neck have multiple complementary threads.

10. The combination of any one of claims 2 to 4, wherein the axial length of said screw-threaded sections of said safety sleeve and said container neck and the distance between said second annular bead and said first annular bead are such that the threaded section of the safety sleeve when turned in the unscrewing direction, is screwable to a point in front of the threaded section of the container neck and then is freely rotatable on the container neck.

11. The combination of claim 1, wherein the portion of the stopper which enters the container mouth is in the form of a barrel-shaped plug part made with an oversize with respect to the inside cross section of the container mouth.

12. The combination of claim 1, wherein the portion of the stopper which enters the container mouth is a cylindrical plug which is undersized with respect to the inside diameter of the container mouth and has integrally injection-molded thereon radially projecting sealing fins.

13. The combination of claim 1, wherein the stopper is provided with a hold-down that is compressible in the axial direction.

14. The combination of claim 1, wherein the section of the container neck and the container itself, directly adjoining the safety sleeve in the axial direction when the container is closed, has a diameter substantially corresponding to the diameter of the safety sleeve.

15. The combination of claim 1, wherein at least one of the circumferential surface of the grip plate and the circumferential surface of the safety sleeve is provided with integrally injection-molded knurling or the like.

16. The combination of claim 1, wherein the margin of the grip plate has corners.

17. The combination of claim 1, wherein the safety sleeve has an outer circumferential surface which, as seen along its longitudinal central axis, has a profile differing from a circular shape.

18. The combination of claim 17, wherein said outer circumferential surface has a polygonal or polyhedral outline.

19. The combination of claim 1, wherein on the outer surface of the stopper entering into the container neck, there is provided a circumferential annular bead with which an annular bead on the inside surface of the container neck is associated, said annular beads being disposed in axial direction of said container such that the annular bead provided on the stopper, upon the pressing of the stopper into the container neck, snaps over the annular bead in the container neck immediately before reaching the proper stoppered position.

20. The combination of claim 19, wherein the inside diameter of the container neck is made slightly smaller in the area adjoining the annular bead of the container neck in the direction towards the container interior away from the mouth in comparison with the inside diameter of the area situated in front of the annular bead on the mouth side.

* * * * *